US005187914A

United States Patent [19]

Leurent

[11] Patent Number: 5,187,914

[45] Date of Patent: * Feb. 23, 1993

[54] CURVED TUBULAR PROFILE

[75] Inventor: Henri G. Leurent, Tourcoing, France

[73] Assignee: Brelan S.A., Luxembourg

[ * ] Notice: The portion of the term of this patent subsequent to Jun. 18, 2008 has been disclaimed.

[21] Appl. No.: 666,589

[22] Filed: Mar. 8, 1991

Related U.S. Application Data

[63] Continuation of Ser. No. 312,858, Feb. 17, 1989, Pat. No. 5,024,040.

[30] Foreign Application Priority Data

Feb. 18, 1988 [FR] France ..... 88 01913

[51] Int. Cl.[5] ..... E04B 1/32

[52] U.S. Cl. ..... 52/738; 52/86

[58] Field of Search ..... 52/86, 235, 63, 738, 52/712, 780, 781

[56] References Cited

U.S. PATENT DOCUMENTS

| | | | |
|---|---|---|---|
| 2,397,345 | 3/1946 | Gilleland | 52/90 |
| 3,110,374 | 11/1963 | Valverde | 52/729 |
| 4,031,680 | 6/1977 | Stoakes | 52/722 |
| 4,583,331 | 4/1986 | Hunt | 52/63 |
| 4,783,861 | 11/1988 | Leurent | 52/86 |
| 4,875,311 | 10/1989 | Meyers | 52/90 |
| 4,878,330 | 11/1989 | Machin | 52/475 |

*Primary Examiner*—Henry E. Raduazo

*Attorney, Agent, or Firm*—Fishman, Dionne & Cantor

[57] ABSTRACT

A bent tubular profile with lateral grooves intended to form arches for a covering-structure which may be removed is presented. The covering-structures may be at least partially removed between each of the pairs of arches thereof by sliding flexible sheets which are preferable made from a plastic material which is generally transparent. The arch is formed by a single-piece bent profile comprising a central bearing body which is tubular and has a round, oval, square, rectangular or polygonal section or is a U-shaped profile. Bearing on each side and perpendicularly to its vertical plane of symmetry are fins arranged one above the other. The device of the present invention is more particularly intended for covering a swimming pool.

6 Claims, 1 Drawing Sheet

CURVED TUBULAR PROFILE

The present application is a continuation of application Ser. No. 312,858, filed Feb. 17, 1989 and now U.S. Pat. No. 5,024,040.

BACKGROUND OF THE INVENTION

The present invention relates to a profile with a tubular or other shape section having outer pairs of grooves arranged laterally on both sides of the central body bearing the profile.

Curved arches have been known which are made from a metal or other type of profile, or are extruded in light alloy, and which are intended for covering-structures which may be partially removed between the arches and which form either a fixed single vault along the entire length of the structure, or fixed and telescopic multiple vaults for covering a swimming pool or other location. These arches generally have a section in the shape of a U, of square or rectangular tubularity, with at least two pairs of grooves arranged one above the other along the entire extension of each arch. The grooves are arranged above a single one of the faces of the part of the central body bearing the profile, and distributed, opposite each other in pairs, on both sides of the vertical axis of symmetry of the profile. In this case, the entire profile is made from a single piece.

While suitable for its intended purpose, this conventional arrangement of pairs of grooves presents a drawback because, since the walls of the latter are a fair distance from the horizontal axis of symmetry of the part of the central body bearing the profile, this arrangement does not make it possible to rapidly and easily obtain (and without costly tools) arches with an elliptical shape or a similar shape comprising more than a single radius of curvature. This is because the walls of these grooves move closer together or warp and are deformed by flexion, this occurring all the more when they are at a distance form the horizontal axis of symmetry of the part of the profile forming its central bearing body.

Notwithstanding, the above discussed problem in the prior art, there is value in having arches with an elliptical shape and in obtaining a height enabling one to stand upright, all this, close to the edges of the structure on the ground, without having too great a height in the center of the arches forming the fixed or telescopic vaults of the structure.

This drawback, on the other hand, does not occur in the case where the pairs of grooves consist of a profile which is independent of the profile forming the central bearing body.

This profile forming the grooves is stackable and is curved separately from the profile forming the central bearing body in a plurality corresponding to the number of walls of grooves required, as described in the document EP-A-0,224,290 (corresponding to U.S. Pat. No. 4,783,861, assigned to the assignee hereof, all of the contents of which are incorporated herein by reference).

In this case, the required distance between the grooves is easily obtained and perfectly controlled. However, there is then another major drawback with the vault structure of U.S. Pat. No. 4,783,861. This drawback consists of the fact that it is necessary to employ an expensive assembly operation, using screws or other means, for fixing each of the independently curved profiles which form, by being stacked on one another, the walls of the pairs of grooves onto a single one of the faces of the bearing profile.

As an example, in a structure which may be applied to covering a swimming pool, each half of a pair of grooves, of a pair of arches, is opposite, supports and guides its own sheet, preferably made from a flexible plastic material which is generally transparent. Together, between the arches, the sheets close off the bearing structure formed by the arches.

Each of these sheets slides along the entire length of the extension of the arches, being deformed according to the variable radius of curvature of the arches.

The sheets may be placed on top of one another between each pair of arches at arbitrary points in the extension of the arches in order to obtain partial uncovering between each pair of arches, which uncovering may, in the case of, for example, three pairs of grooves supporting three sheets between each arch, uncover up to approximately two-thirds of the part of the structure included between each pair of arches.

Therefore, in order that each of the sliding sheets may be maneuvered satisfactorily, it is essential that the walls of the grooves which receive them have a constant and uniform spacing, are not deformed or flexion and that this spacing is also the same after the necessary bending operation which enables the arches to be formed.

An object of the present invention then is to produce arches, intended for covering-structures which are partially removable between the arches, which have the shape of a half ellipse or a similar shape comprising more than a single radius of curvature, using a profile made from a single piece. It is still another object that these arches have outer fins forming pairs of grooves, without having to assemble these fins on a bearing profile, using screws or other means. The profiles being independent of said bearing profile, and independently bending in order to form these grooves. Still another object of this invention is that the walls of these grooves do not come close to each other and do not warp on bending. All of these features and objects, must be obtained easily, rapidly and without special or expensive tools.

SUMMARY OF THE INVENTION

In accordance with the present invention, these objects are achieved by virtue of a profile intended for covering structures which are partially removable between each of the pairs of arches thereof, by sliding flexible sheets, preferably made from a plastic material which is generally transparent wherein the profile is made from a single, bent metallic piece, comprising a tubular bearing body, bearing on each side, and perpendicularly to its vertical plane of symmetry, are fins arranged one above the other and together defining at least three grooves on each side of the bearing body.

DESCRIPTION OF THE PREFERRED EMBODIMENT

Figure 1:
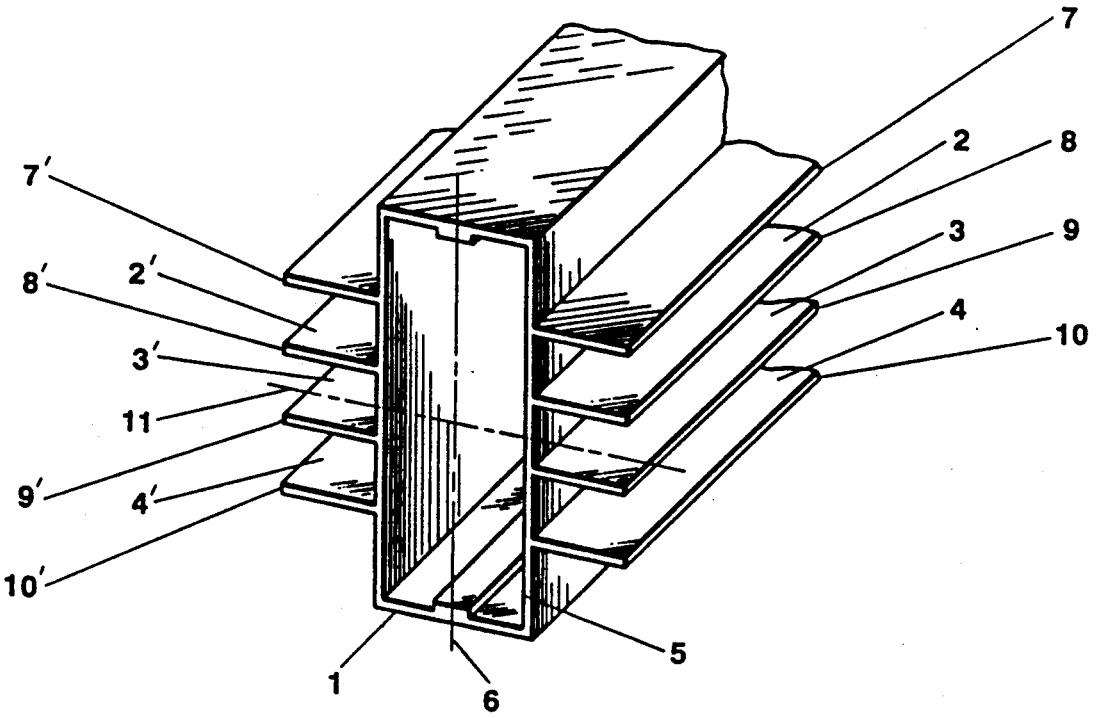
FIG. 1 is a perspective of a profile in accordance with the present invention, made from a single piece, with grooves arranged laterally with respect to its central bearing body and intended to form arches for a covering-structure which may be removed between each of the pairs of arches thereof.
Figure 2:
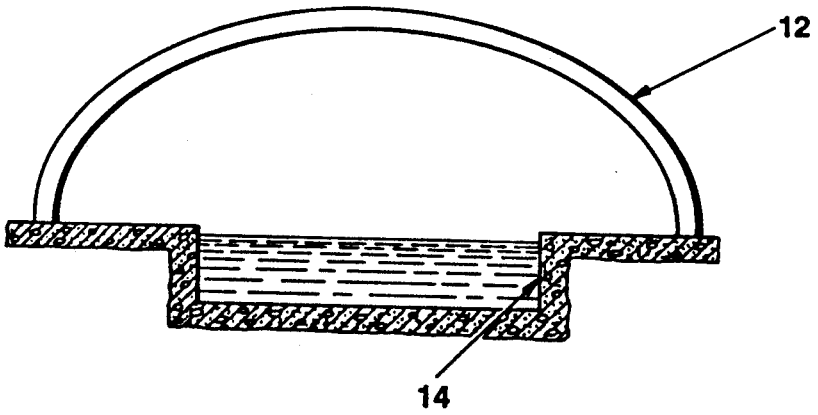
FIG. 2 is a diagrammatic view, in vertical cross section, of an arch of the present invention in conjunction with a swimming pool.

In a preferred embodiment, the rectangular profile 1 in accordance with the present invention bears the grooves 2 and 2', which are formed by the fins 7 and 8 and 7' and 8', respectively; the grooves 3 and 3', formed by the fins 8 and 9 and 8' and 9', respectively; and the grooves 4 and 4' formed by the fins 9 and 10 and 9' and 10', respectively. These grooves are distributed on either side laterally and perpendicularly to the central bearing body in the form of a box 5 and to the vertical axis of symmetry 6 of the rectangular tubular profile 1 on each side of the latter. In the vertical direction, the grooves are distributed uniformly on both sides of the horizontal axis of symmetry 11 of the rectangular tubular profile 1.

By bending the tubular profile 1, in the case of three pairs of grooves 2, 3, 4 and 2', 3', 4' (the middle 3 and 3' being centered with respect to the horizontal axis of symmetry 11 of the tubular profile 1), and distributing the two other pairs of grooves 2 and 2' and 4 and 4', one on each side of the grooves in the middle 3 and 3', it is necessary to take into consideration, for the bending operation and with respect to the risk of deformation and of the walls of the grooves coming closer together as a result of this operation, the distance of one groove and a half as the distance of their spacing from the horizontal axis of symmetry 11 of the tubular profile 1. It will be appreciated that this distance is small using this arrangement and in this case, it does not risk creating difficulties and deformations on bending.

This profile 1 as defined above, with its lateral fins forming the walls of the grooves, is made from a single piece or a single profile and makes it possible to produce arches which are bent in the shape of a semi-ellipse or in another similar shape, comprising more than one single radius of curvature, in one single bending operation while keeping the walls of the grooves parallel and preserving their initial spacing.

In accordance with the present invention, this arrangement makes it possible to produce a lighter profile with an inertia which is equal with respect to the solution of a bearing profile which is independent of the profile forming its grooves, to carry out only one bending operation and to not have to perform an operation of assembling various profiles forming the grooves on the bearing profile.

By virtue of the present invention, the distance of the various fins to the horizontal axis of symmetry 11, which remains a neutral axis, is reduced to a minimum value even after bending of the profile 1, a distance which is in any case less than the height of the central bearing body of the profile 1. This is in contrast to the prior art where the fins and the bearing part of the profile are one and the same profile, the said fins forming the pairs of grooves are located beyond its upper face which is the outer face of the bent bearing profile, thereby causing proportionately greater bending problems.

By virtue of the present invention, it is not, moreover, necessary to use the solution of fins formed by a profile which is stackable, independent of the bearing profile, (as in U.S. Pat. No. 4,783,861) which solution involves as many bending operations as there are profiles which are independent of one another, and also a long and expensive operation for assembling and fixing all the profile together.

It is possible to provide on one of the sides of the profile 1, in this case that which is the inner side after bending, a groove which permits the fixing or the anchoring of a seat, it being possible for this groove to penetrate the body of the profile up to the level of the fins 10 and 10'.

While preferred embodiments have been shown and described, various modifications and substitutions may be made thereto without departing from the spirit and scope of the invention. Accordingly, it is to be understood that the present invention has been described by way of illustrations and not limitation,

What is claimed is:

1. An extruded metal profile for forming arches used in covering structures, comprising:

a curvilinearly extending tubular central bearing body having opposed sides and having, in a transverse cross sectional view, a vertical axis of symmetry, said curvilinearly extending body being obtained by bending a tubular extrusion; and a plurality of fins arranged one above the other and together defining at least three grooves on each side of said body for receiving flexible sheets, said fins extending from each of said opposed sides of said body and, being perpendicular to said vertical axis, wherein each of said fins extends from the body to an end and exhibits, in a transverse cross sectional view, a straight top edge extending from the body to the end and a straight bottom edge extending from the body to the end, said top and bottom edges each extending perpendicular to the vertical axis and wherein said profile comprises a single piece.

2. A profile according to claim 1 including:

at least four fins defining three pairs of grooves extending from each of said opposed sides of tubular central bearing body.

3. A profile according to claim 1, wherein said profile is bent according to several radii of curvature.

4. The profile of claim 1, wherein the profile is bent in the shape of a hemi-ellipse.

5. The profile of claim 1, wherein the opposed sides of the body comprise opposed lateral sides.

6. An arch for covering structure, comprising:

a unitary, curvilinearly extending metal profile, said profile comprising:

a tubular central body having opposed sides and having, in a transverse cross sectional view, a vertical axis of symmetry;

a plurality of fins extending along each of said opposed sides perpendicular to the vertical axis, said fins being arranged one above the other and being spaced apart to define at least three grooves therebetween along each side of the body, wherein each of said fins extends from the body to an end and exhibits, in a transverse cross sectional view, a straight top edge extending from the body to the end and a straight bottom edge extending from the body to the end, said top and bottom edges each extending perpendicular to the vertical axis and wherein said profile comprises a single piece.

* * * * *